US006484001B1

(12) United States Patent
Sirejacob

(10) Patent No.: US 6,484,001 B1
(45) Date of Patent: Nov. 19, 2002

(54) PROCESS FOR RECYCLING A TONER CARTRIDGE

(75) Inventor: Gino Sirejacob, Evergem (BE)

(73) Assignee: CF Technologies, Deinze (BE)

( * ) Notice: Subject to any disclaimer, the term of this patent is extended or adjusted under 35 U.S.C. 154(b) by 0 days.

(21) Appl. No.: 09/838,761

(22) Filed: Apr. 19, 2001

Related U.S. Application Data

(62) Division of application No. 09/395,389, filed on Sep. 13, 1999, now Pat. No. 6,248,179.

(51) Int. Cl.[7] ..... G03G 15/00

(52) U.S. Cl. ..... 399/109; 29/402.04; 29/402.18; 29/895.1

(58) Field of Search ..... 399/109, 350; 29/402.03, 402.04, 402.18, 895.1; 156/94

(56) References Cited

U.S. PATENT DOCUMENTS 4,958,197 A * 9/1990 Kinashi et al. ..... 399/350
5,196,888 A * 3/1993 Matsuda et al. ..... 399/267
5,644,828 A * 7/1997 Sailer et al. ..... 29/895.1 X
5,678,140 A * 10/1997 Fuei et al. ..... 399/109
5,765,286 A * 6/1998 Sato et al. ..... 29/895.1
5,781,830 A * 7/1998 Gaylord et al. ..... 399/109
5,870,654 A * 2/1999 Sato et al. ..... 399/109

FOREIGN PATENT DOCUMENTS

JP 58-098735 * 6/1983
JP 09-311518 * 12/1997

* cited by examiner

*Primary Examiner*—Sophia S. Chen
(74) *Attorney, Agent, or Firm*—Darby & Darby

(57) ABSTRACT

A process is presented for recycling a toner cartridge, including a used magnetic roller and a used doctor blade. The process requires: (1) removal of the doctor blade and magnetic roller from the cartridge; (2) treatment of the doctor blade to restore the shape of said doctor blade; (3) coating of the doctor blade and magnetic roller with an antistatic and anti abrasive coating; and (4) placement of the doctor blade and magnetic roller back into the cartridge. Additional processes involving reuse of other toner cartridge components are also described.

6 Claims, 10 Drawing Sheets

PROCESS FOR RECYCLING A TONER CARTRIDGE

This patent is a divisional from patent application Ser. No. 09/395,389, now U.S. Pat. No. 6,248,179, filed on Sep. 13, 1999 and issued on Jun. 19, 2001.

THE PRIOR ART

In the recycling technology of toner cartridges of copiers, facsimile machines and laser printers, it has been proposed to provide the photosensitive drum or the magnetic roller or primary charging roller with a coating. For these purposes, devices have been proposed for facilitating the coating step. The said devices use a swab impregnated with the coating composition (a liquid composition). In the known devices, the swab contact the drum or roller while driven in rotation, and the swab is moved horizontally and parallel to the axis of rotation of the drum or roller. Therefore, the amount of composition released from the swab when beginning the coating is higher than the amount of composition released from the swab at the end of the coating step. Problems of such a coating are:

not uniform coating, risk of lack of coating composition for the last coated part of the drum or roller, whereby a part of the roller or drum to be coated can remain uncoated, due to a lack of composition in the swab.

The present invention has for subject matter a device whereby a substantially uniform coating can be obtained on elements such as drums, rollers, blades can be obtained.

BRIEF DESCRIPTION OF THE INVENTION

The invention relates to a device for coating at least a part of an element by means of a swab impregnated with a coating composition, said device comprising:

a support provided with a guiding path and with a means for bearing the element to be coated;

a mobile carriage with means for bearing the swab, said carriage being movable along the guiding path;

a means for ensuring a movement of the mobile carriage along the guiding path with respect to the element to be coated;

a means for pushing the swab towards the element to be coated so that a quantity of the composition released from the swab coats the element, and a means for varying the quantity of released composition per unit of length of movement of the mobile carriage along at least a path of the guiding path, so that the coating of the said part is substantially uniform.

Advantageously, the device further comprises a room in which at least the support and the mobile carriage are located, said room being provided with an inlet connected to an air cleaning system. Preferably, the said inlet is adapted for ensuring a substantially laminate flow at least in the neighborhood of the support and the mobile carriage. Such an air inlet is advantageous for preventing dust or other solid particles to enter into the applied and/or to be applied on the coating before its complete hardening or its tack free.

According to an embodiment, the device further comprises a table, a vertical supporting element, and fixing means, whereby the support is movable between a first position in which the support is fixed to the table and a second position in which the support is fixed on the vertical supporting element. Preferably, the vertical supporting element is mounted pivotable around a vertical axis. Preferably, especially when the element to be coated is a drum or a roller, the device further comprises a driving means for driving into rotation the element to be coated.

A preferred device of the invention comprises:

a support provided with guiding path and with a means for beating the element to be coated;

a mobile carriage with means for bearing the swab, said carriage being movable along the guiding path;

a means for ensuring a movement of the mobile carriage along the guiding path with respect to the element to be coated;

a means for pushing the swab towards the element to be coated so that a quantity of the composition released from the swab coats the element, and a means for varying the quantity of released composition per unit of length of movement of the mobile carriage along at least a part of the guiding path, so that the coating of the said part is substantially uniform, whereby the said means for varying the quantity of released composition per unit of length of movement of the mobile carriage along at least a part of the guiding path is a means pushing of the swab towards the element to be coated during a movement of the mobile carriage along at least a part of the guiding path.

Advantageously, the means for varying the pushing of the swab towards the element to be coated varies the said pushing of the swab towards at least a part of the element during the movement of the carriage corresponding to the coating of the said part of the element by the swab, the said pushing varying substantially continuously from a first pushing force and a second pushing force so that the coating of the said part is substantially uniform. For example, in case of a vertical pushing of the swab towards the element to be coated, the said pushing varying substantially continuously from a first pushing force and a second pushing force higher than the first pushing force so that the coating of the said part is substantially uniform, while for a horizontal pushing of the swab towards the element, the said pissing varying substantially continuously from a first pushing force and a second pushing force lower than the first pushing force so that the coating of the said part is substantially uniform.

According to an advantageous embodiment, the mobile carriage has a body movable along the guiding path, said body being provided with a pivoting piece bearing the swab. The pivoting piece is preferably pivoting around an axis with respect to the body, said axis being advantageously parallel to the axis of the guiding path.

According to an embodiment, the means for ensuring a movement of the mobile carriage along the guiding path with respect to the element to be coated moves the said mobile carriage according to a back-and-forth motion. At least during a part of the forth motion, the swab contacts the element to be coated. Preferably, the device further comprises a means for moving the swab at tile element to be coated a side during the back motion to the carriage.

The device comprises advantageously a means for moving the swab and the element aside before the coating of the element and/or after the coating of the element, for example just alter the end of the coating step. This is advantageous in order to ensure that during a first relative movement of the carriage, the swab is progressively movement towards the element, while kit the end of the coating, during a relative movement of the carriage, the swab is progressively removed from the element. Thus the swab when in relative movement with respect to the element to be coated is moved from a position aside the element to a contact position with the element before starting the coating operation, and from a position in contact with the element to a position aside after ending the coating.

According to an advantageous embodiment, the device further comprises a means for holding the swab and the element aside when the carriage is adjacent to a first position of the guiding path, and a means for displacing at least a part of the carriage when the carriage is moved away from the said first position, so that the swab contacts the element. This movement of the swab is advantageously realized by a roller working with a nock.

According to a specific embodiment, the means for bearing the element to be coated comprises two bearing elements between which the element to be coated is placed, said bearing elements being aligned along a first axis, said axis being preferably the axis of rotation of the element to be coated. The mobile carriage is movable along an axis parallel to the guiding path of the carriage, said axis being distant from the said first axis and being not particle to the said first axis. The second axis forms advantageously an angle with a line parallel to the said first axis and crossing the said second axis, said angle being preferably comprised between 0.1° and 15°, for example between 0.1° and 5°, especially between 0.2 and 2°.

The invention relates also to a process for coating an element with a coating composition, in which a swab impregnated with the coating composition is contacted with the element to be coated and is in relative longitudinal movement with respect to the element to be coated so as to release a quantity of composition for coating a part of the element, and in which the quantity of composition released by the swab per unit of length of relative movement of the swab with respect to the element is controlled so that the coating of the said part of the element with the composition is substantially uniform.

Advantageously, the swab contacts the element in an air clean environment, for example, an air clean environment containing substantially no particles with a size greater than 5 $\mu$m, preferably containing substantially no particles with a size greater than 1 $\mu$m. This is advantageous for preventing the presence of undesired large particles (dusts, etc.) in the coating or on the coating.

Preferably, the swab contacts the element in an air environment with a temperature comprised between 15 and 30° C. or with a controlled temperature and/or with a relative humidity of less than 50% (preferably of less than 40% or in a substantially dry air). Advantageously, the swab contacts the element in a substantially laminar clean airflow. The air environment can be controlled so as to adapt the temperature and/or the humidity and/or the speed of the air flow for obtaining the required coating, for example for controlling the evaporation of the solvent used in the composition, and/or for controlling the reaction speed and/or for ensuring a good application of the composition on the element to be coated.

Advantageously, the element is driven in rotation, and the swab contacts the element while rotating.

In the process of the invention, the swab is advantageously pressed with a controlled pressure on the element for obtaining an uniform coating. For example, the swab is pushed with a pushing force on the element to be coated, the said pushing force being controlled during the relative movement of the swab with respect to the element so as to obtain an uniform coating of the element.

When the swab is pushed with a vertical pushing force on the element to be coated, the said vertical pushing force is advantageously controlled during the relative movement of the swab with respect to the element so as that said vertical pushing force varies continuously front a first pushing force to a second pushing force, said second pushing force being greater than the first pushing force.

When the swab is pushed with a horizontal pushing force on the element to be coated and in which the said horizontal pushing force is controlled during the relative movement of the swab with respect to the element so as that said horizontal pushing force varies continuously from a first pushing force to a second pushing force, said second pushing force being lower than the first pushing force.

According to an advantageous embodiment of the process of the invention, the swab is moved with a back-and-forth motion with respect to the element to be coated, in which the swab contacts the element during at least a part of the forth motion, and in which the swab and the element are aside during the back motion of the swab.

Preferably, the coating composition is a composition for obtaining an antistatic and anti abrasive coating. Most preferably, the coating composition is a composition for obtaining an anti static, anti fog, anti stick, heat resistant, chemical resistant and anti abrasive coating.

The invention further relates to a process for recycling a toner cartridge comprising at least a magnetic roller and a doctor blade, in which the said doctor blade and magnetic roller are removed from the cartridge, in which the removed doctor blade anal magnetic roller are coated with an antistatic and anti abrasive coating, and in which, after coating, the said doctor blade and magnetic roller are placed back in the cartridge. Before the coating operation, the doctor blade and magnetic roller are preferably cleaned. If required, the doctor blade is submitted to a treatment for substantially restoring the initial shape of the blade, for example by a heat treatment and by application of a pressure on the blade.

The invention relates also to:

- a process for recycling a toner cartridge comprising at least a magnetic roller, a doctor blade, a photosensitive drum, a wiper blade, a fists roller and a primary charge roller, in which the photosensitive drum and the wiper blade are removed from the cartridge, in which the removed photosensitive drum and wiper blade are coated with an antistatic and anti abrasive coating, and in which, after coating, the said photosensitive drum and the wiper blade are placed back in the cartridge;
- a process for recycling a toner cartridge comprising at least a magnetic roller, a doctor blade, a photosensitive drum, a wiper blade, a fuser roller and a primary charge roller, in which at least three elements selected among the group consisting of magnetic roller, doctor blade, photosensitive drum, wiper blade, fuser roller and primary charge roller are removed from the cartridge, in which the said removed elements are coated with an anti abrasive coating, and in which, after coating, the said elements are placed back in the cartridge. The coating of the fuser roller is preferably an anti stick and anti abrasive roller, while the coating of the other elements of the toner cartridge to be coated is an anti static and anti abrasive coating.

BRIEF DESCRIPTION OF THE DRAWINGS

FIGS. 10 to 15 are schematic views of the position of the carriage during its relative movement with respect to the element to be coated (the FIGS. 10 to 15 showing the position of the carriage respectively along the lines X—X, XI—XI, XII—XII, XIII—XIII, XIV—XIV in the support of FIG. 5 during the forth movement of the carriage, while FIG. 15 shows the position of the carriage during the back movement of the carriage);

DESCRIPTION OF A PREFERRED EMBODIMENT

Figure 1:
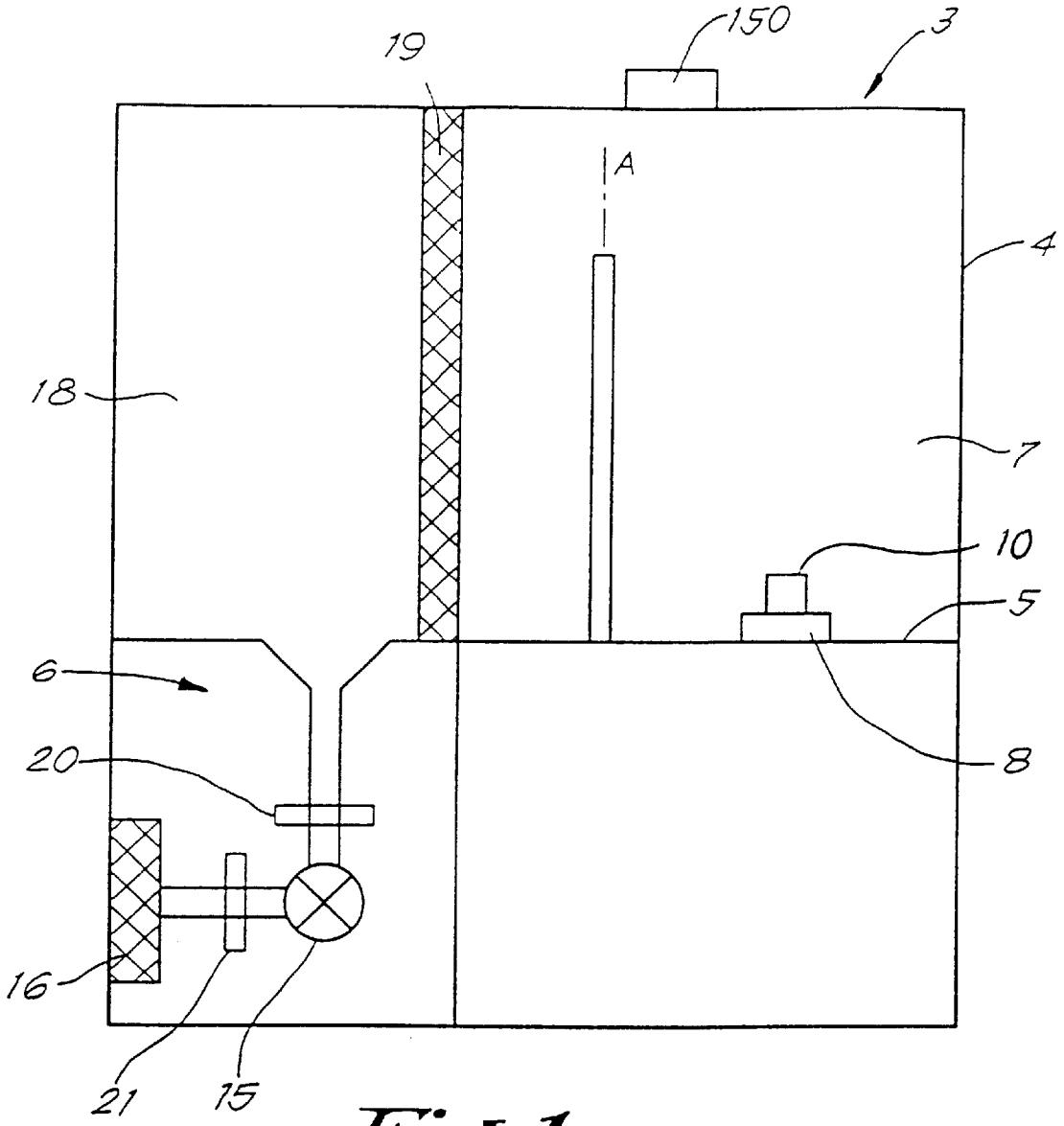
FIG. 1 is a schematic side view of a preferred device of the invention.
Figure 2:
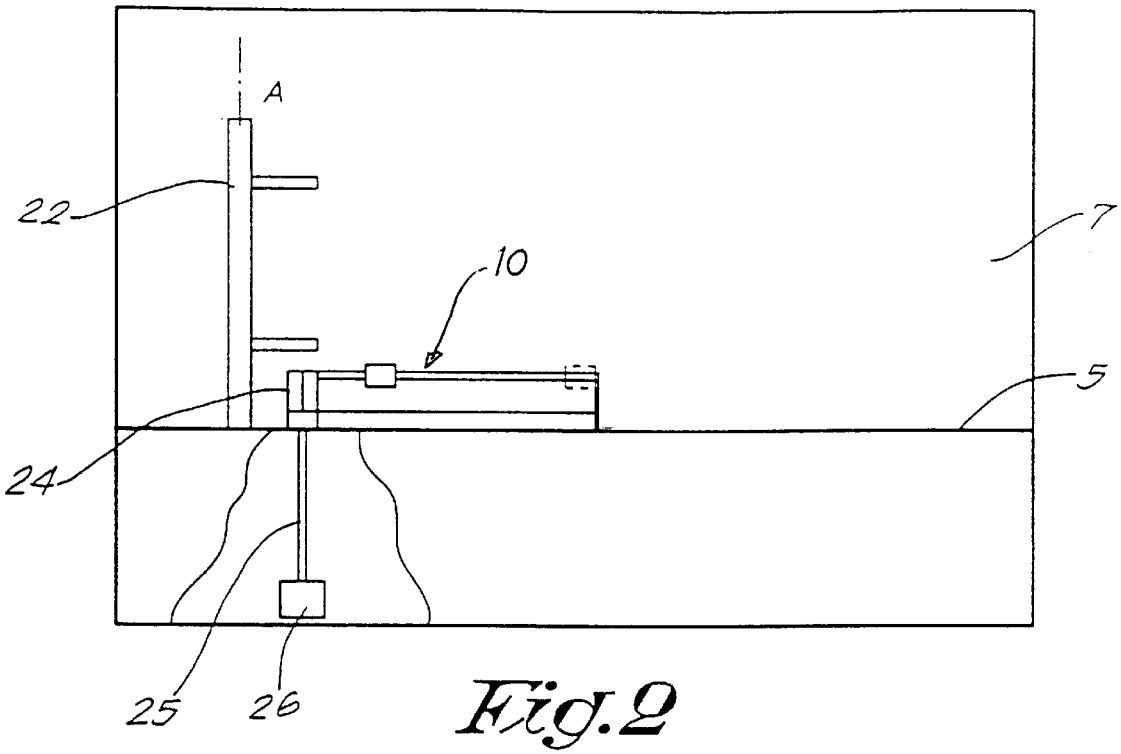
FIG. 2 is a schematic front view of the device of FIG. 1.
Figure 3:
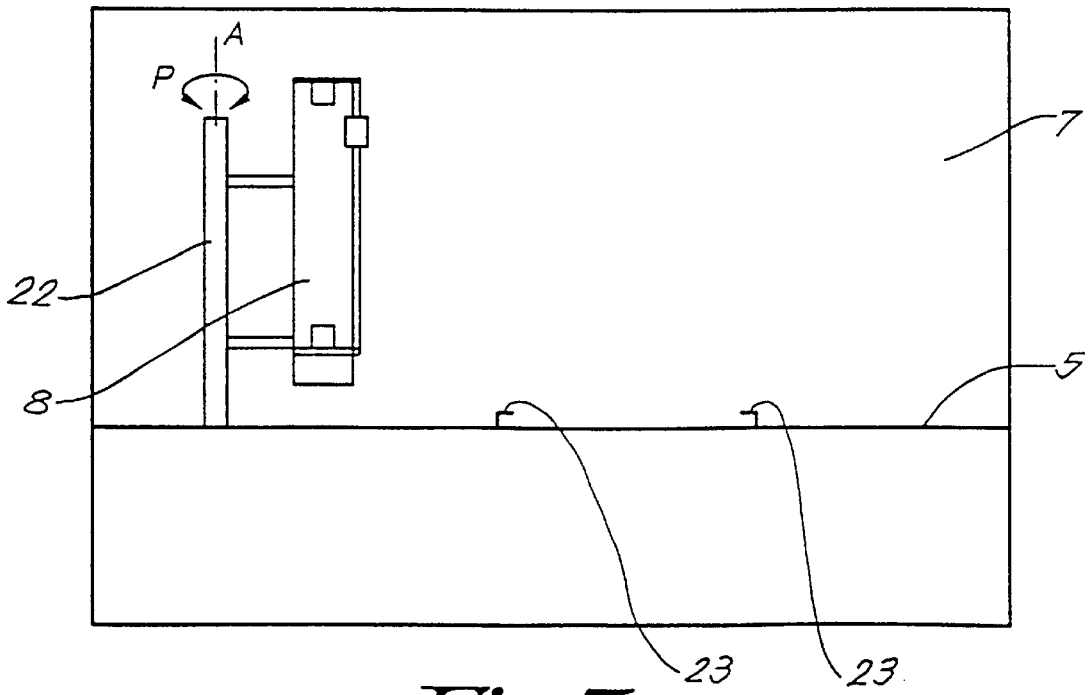
FIG. 3 is a schematic front view of the device of FIG. 1 with the coating device in vertical position.
Figure 4:
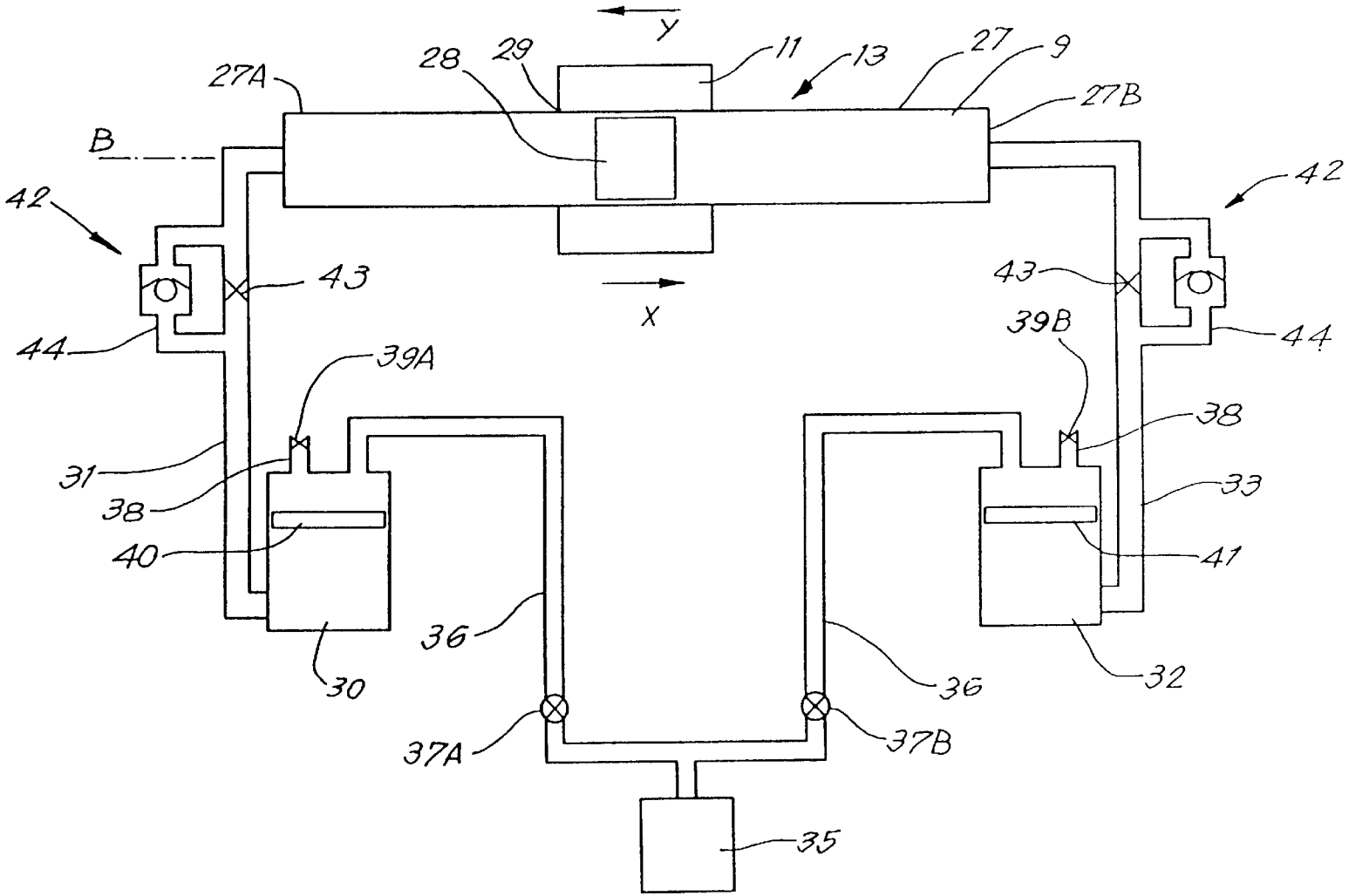
FIG. 4 is a schematic view of the control circuit of the carriage or the coating device.
Figure 5:
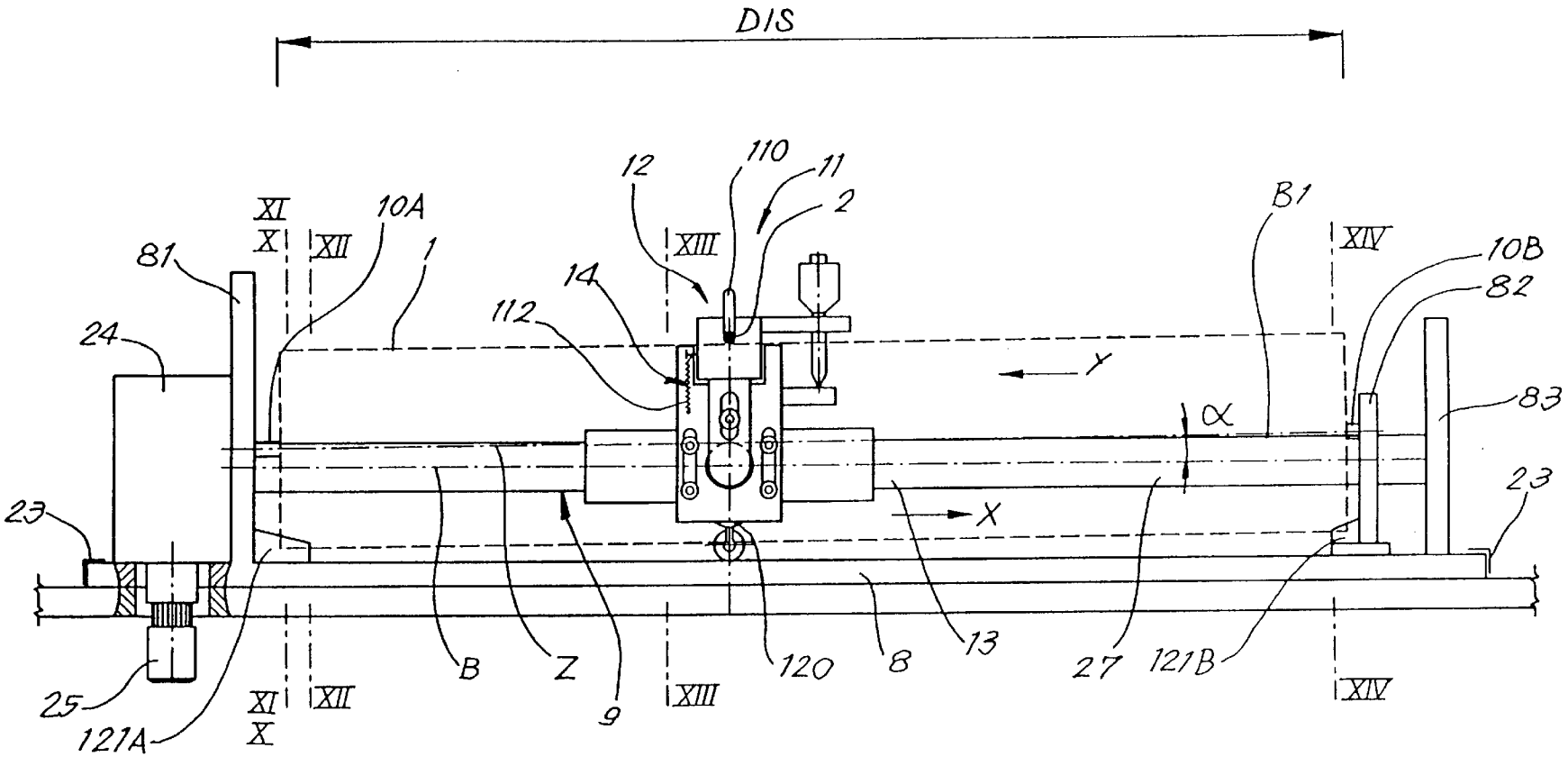
FIG. 5 is a front schematic view of the support provided with the coating device.
Figure 6:
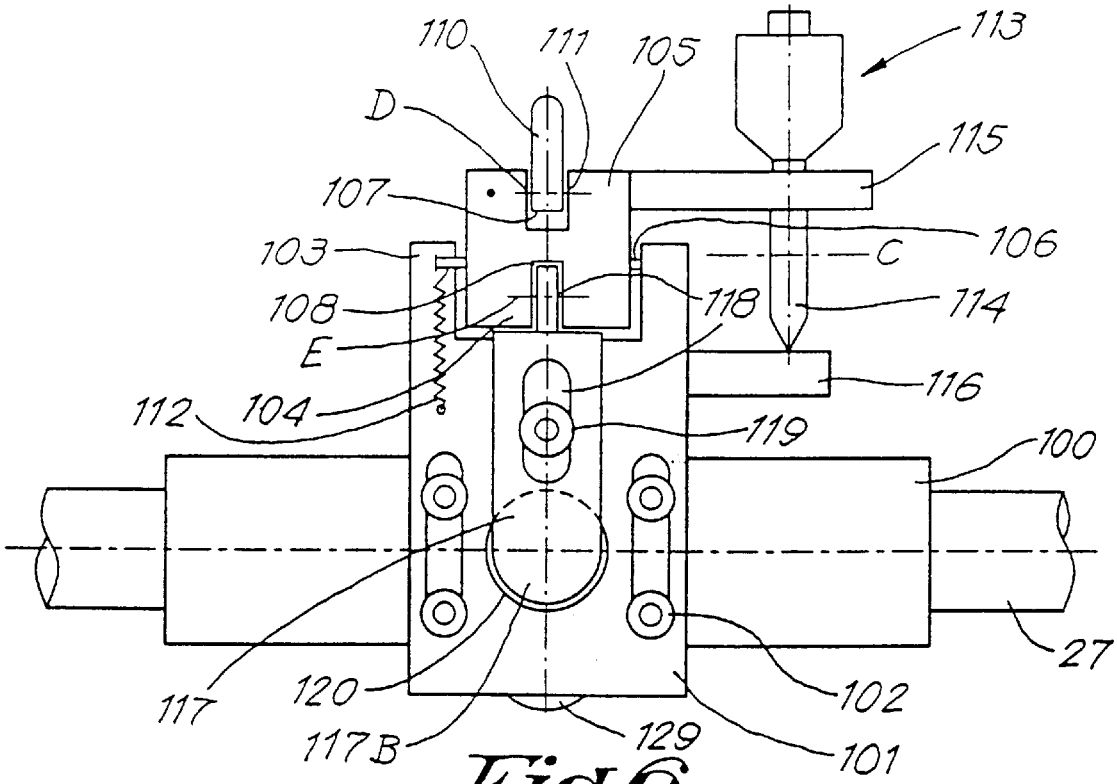
FIGS. 6 to 9 are respectively a front schematic view, a back view and side views of the coating device or FIG. 5.
Figure 7:
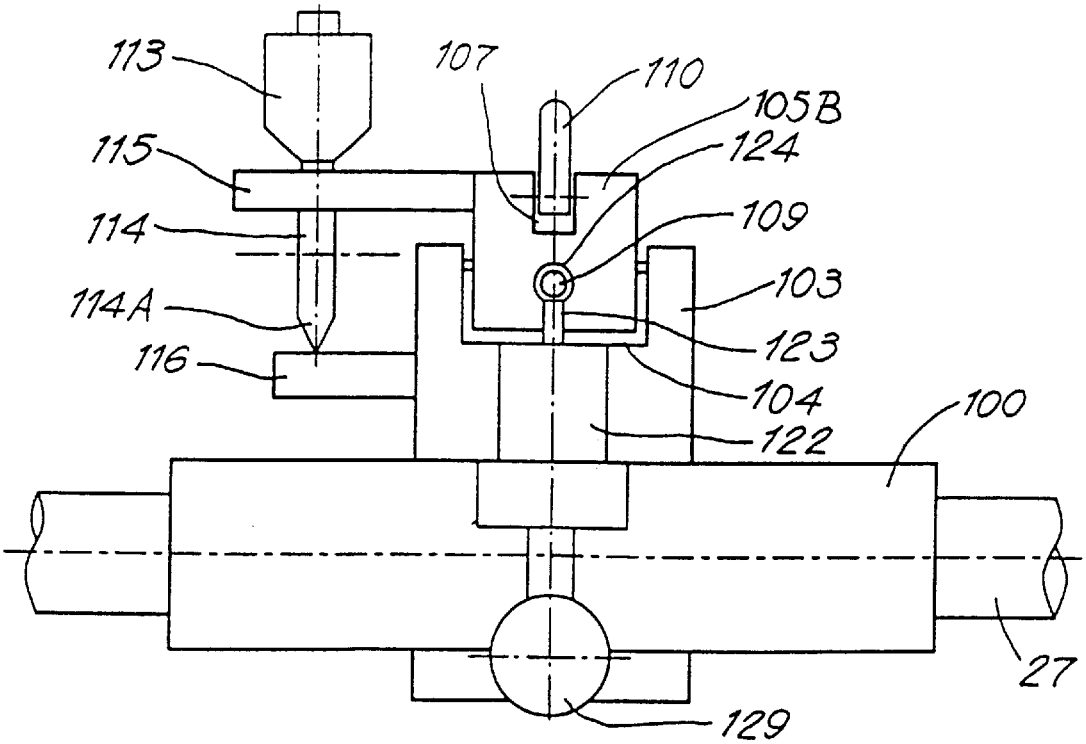

The device shorn schematically in FIG. 1 is a device for coating at least a part to an element 1, such as a drum or roller, by means of a swab 2 impregnated with a coating composition, said device comprising:

- a cabinet 3 with a front opening 4, a table 5 an air cleaning system 6 for controlling environment of at least a part of the working room 7;
- a support 8 provided with a guiding path 9 and with a means 10 for bearing the element 1 to be coated;
- a mobile carriage 11 with means 12 for bearing the swab 2, said carriage being movable along the guiding path 9,
- a means 13 for ensuring a movement of the mobile carriage 11 along the guiding path 9 with respect to the element 1 to be coated;
- a means 14 for pushing the swab towards the element 1 to be coated so that a quantity of the composition released from the swab 2 coats the element,
- a means for varying the quantity of released composition per unit of length of movement of the mobile carriage along at least a part of the guiding path, so that the coating of the said part is substantially uniform.

The air cleaning system comprises a fan 15 sucking air through an air filter 16 and pushing said sucked air in a distribution room 18 provided with an outlet consisting of a compressible porous foam layer 19, into the working room 7. The fan is controlled so that the air flow entering in the working room is substantially laminar and so that the working room is under a pressure higher than the pressure outside the working room so as to prevent air to flow in the working room 7 through the opening 4. The speed of the laminar flow is for example lower than 2 m/s, for example comprised between 0.05 m/s and 0.5 m/s. The air cleaning system is advantageously provided with a system 20 for controlling the temperature of the air (for example for heating the air at a temperature 20–30° C.), a system (21) for controlling the relative humidity of the air (for example for obtaining a substantially dry air). Such an air flow (of cleaned air) prevents dust or solid particles to deposit on the coating, for example before the tack free or complete hardening of the composition applied on the element. Such an air flow is also advantageous for preventing the formation of big drop of composition, as possible drop formed on the element is pressed on the element due to the air flow. The control of the temperature of the air flow is also advantageous for controlling the hardening of the composition. The hardening and/or tack free of the composition can therefore be effected in the substantially preferred conditions. Possibly, the temperature of the air flow can be controlled so that the temperature of the air flow during the coating is lower than the temperature of the air flow after the coating. This could be advantageous for preventing as much as possible the hardening of the composition during the coating, while improving or accelerating the hardening of the composition after the end of the coating.

The cabinet 3 provided with a cleaning system as described hereabove is already suitable for coating element with known coating devices using impregnated swab. When using such a cabinet provided with said cleaning system in a coating operation using a known coating device, it is possible to dust or solid particles to deposit on the coating, for example before the tack free or complete hardening of the composition applied on the element. By controlling the air flow, it is possible to prevent the formation of big drops of composition. By controlling the humidity of the air and/or the temperature of the air and/or the speed of air flow, it is possible to have a control of the hardening of the coating or of the time required for obtaining a tack free coating. Possibly, the temperature of the air flow can be controlled so that the temperature of the air flow during the coating is lower than the temperature of the air flow after the coating. This could be advantageous for preventing as much as possible the hardening of the composition during the coating, while improving or accelerating the hardening of the composition after the end of the coating.

The table 5 is provided with a vertical supporting element 22 and with fixing means 23, whereby the support 8 is movable between a first position in which the support is fixed to the table 5 and a second position in which the support 8 is fixed on the vertical supporting element 22. Preferably, the vertical supporting element is mounted pivotable around a vertical axis A. This is advantageous for adapting the direction of air flow with respect to the support, by a simple rotation of pivotment P of the support around the axis A.

The support 8 is provided with a gear mechanism 24 intended to be connected to an axis 25 driven in rotation by a motor 26. The gear mechanism 24 and the axis 25 which can be separated, are advantageously adapted for a direct connection there between. The gear mechanism 24 when driven in rotation drives in rotation the element to be coated, such as a drum or a roller.

In this embodiment, the means for varying the pushing H of the swab 2 towards the element 1 to be coated varies the said pushing of the swab towards the element during the movement of the carriage 11, the said pushing force so that the coating of the said part is substantially uniform. For example, in case of a vertical pushing of the swab towards the element to be coated, the said punching varying substantially continuously from a first pushing force and a second pushing force higher than the first pushing force so that the coating is substantially uniform, while for a horizontal pushing of the swab towards the element, the said pushing varying substantially continuously from a first pushing force and a second pushing force lower than the first pushing force so that the coating is substantially uniform.

The guiding path of the carriage 11 can take various forms. For example, said guiding path is a circuit provided with balls, sliding rail(s), a rod for example of a jack, etc.

However, the guiding path 9 of the carriage 11 comprises advantageously a cylinder 27 in which a magnetic piston 28 is movable. The carriage 11 has a cylindrical hole 29 in which the cylinder 27 is engaged, whereby the carriage can slide along the cylinder 27. The carriage is made in a material in a material so that the said carriage, due to the magnetic field of the piston 28, follows the movement of the piston. For the movement of the piston 28, the cylinder 27 is connected to a first end 27A to a jack 30 through a conduit 31, and at a second end 27B to a jack 32 through a conduit 33. The jacks 30,32 are connected to a means 35 through conduits 36 provided with a control valve 37A, 39B. The jacks 30, 32 are provided with a gas outlet 38 with a control outlet valve 39A, 39B. The jacks 30, 32 are provided with a as outlet 38 with a control valve 39A, 39B. The cylinder 27 add the parts of the jacks 30, 32 connected thereto are filled with a hydraulic fluid, such as water, oil, etc. When the valve 37A is open (valve 37B closed, valve 39A closed), pressurized air flows in the upper part of jack 30, whereby moving piston 40 downwards, so that hydraulic fluid flows from jack 30 towards the cylinder 27. This flow of hydraulic fluid induces a movement of the piston 28 towards the end 27B and thus a movement of the carriage towards said end 27B, as well as a flow of hydraulic fluid from the cylinder 27 towards jack 32. The valve 39B is open, so that air can be removed from the upper part of the jack 32 during the upwards movement of the piston 41 due to the flow of hydraulic fluid in the jack 32 during the upwards movement of the piston 9*/41 due to the flow of hydraulic fluid in the jack 32. For having a movement of piston 28 towards the end 27A, pressurized air is lead into the upper part of jack 32 (valve 39B closed, valve 39A open) so as to move piston 28 towards the end 27A. Hydraulic fluid of the cylinder 27 flows then in the jack 30. The valve 39A is open for enabling the outlet of air during the upwards movement of piston 40. For ensuring a correct control of the movement of the piston (magnetic piston), the conduits 31 and 33 are provided with a system 42 comprising a means 43 for limiting the flow of hydraulic fluid from the jack 32 to the cylinder 27 or the flow of hydraulic fluid from the jack 32 to the cylinder, said system further comprising a by pass 44 for permitting a flow (with a low pressure) of fluid from the cylinder to the jack 30. By using this mechanism, the carriage 11 is movable according to a forth-and-back movement (X,Y). In the drawings, the forth motion is drawn as being a movement from the left towards the right. It is obvious that the device can be adapted so that the forth motion corresponds to a motion from the right to the left.

Figure 10:
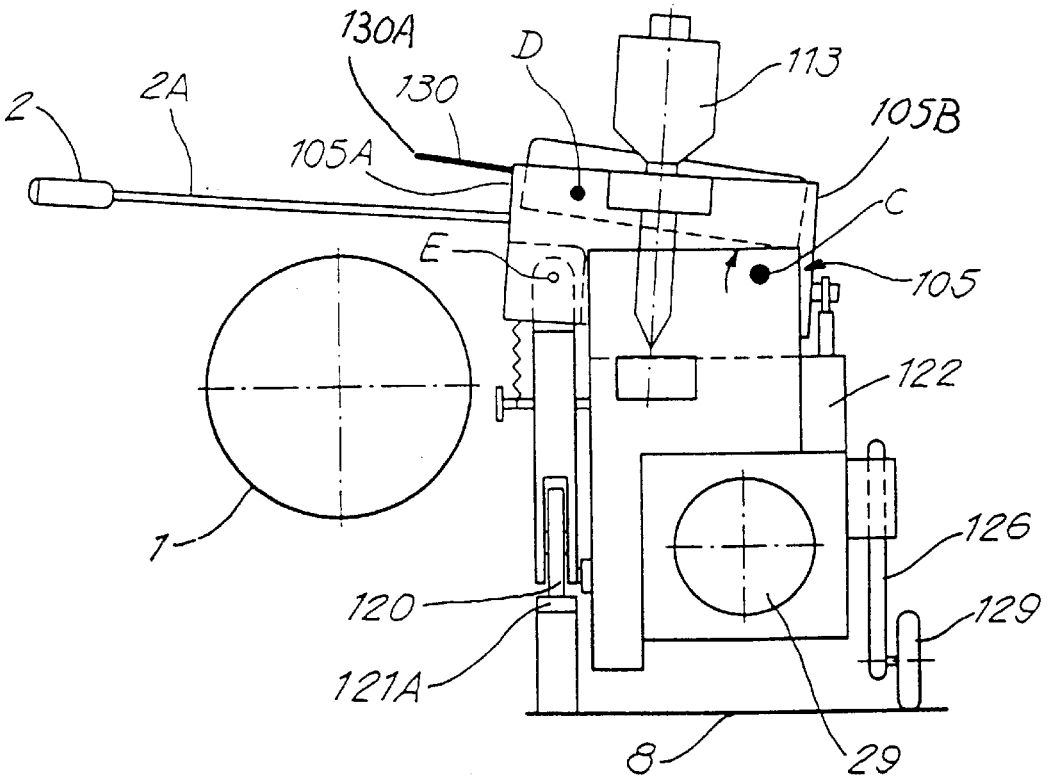
Figure 11:
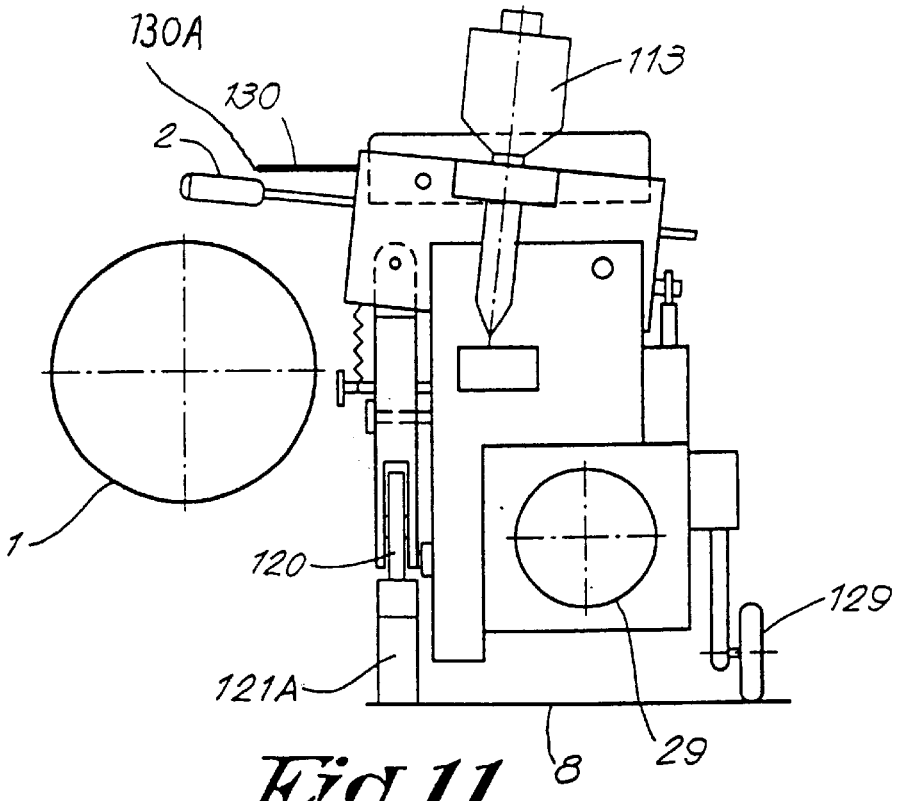

The carriage 11 comprises:

a body 100 with the cylindrical hold 29 in which the cylinder 27;

apiece 101 attached to the body 100 by meiosis of screws 102, said piece 101 having two arms 103 defining there between a channel 104;

a piece 105 connected to the arms 103 by means of a pivot 106, whereby said piece 105 can pivot around the axis C, said piece 105 having an back rod 109, an upper groove 107 and at downwards access 108;

a plate 110 partly engaged in the upper groove 107 and connected to the piece 105 by a pivot 111, so that the plate can pivot around an axis D between a position in which the rod 2A of the swab 2 can be engaged between the bottom of the groove 107 and the plate (see FIG. 10) and a position in which the plate 110 acts on the rod 2A for preventing its movement in the groove 107 (see position of tile plate in FIG. 11);

a spring 112 extending between the piece 103 and the piece 105, said spring exerting a force on the piece 105 so that the end 105A provided with the swab 2 moves downwards;

a means 113 for limiting the downwards movement of the end 105A, said means acting therefore as means for adjusting the pressure of the swab 2 on the element to be coated and as means for adjusting the thickness of the coating on the element, said means 113 comprising for example a control means attached to an arm 115 fixed to the piece 105, said control means controlling the displacement of an adjustable screw or rod 114, the free end 114A of(which is intended to work with a plate 116 attached to the piece 101;

a leg 117 having an upper part 117A engaged in the recess 108 of the piece 105, said upper part 117A being connected to the said piece 105 by means of a pivot 118 whereby the leg can pivot around the axis E, the downwards part 117B of the leg 117 is provided with a roller 120, while the central part of the leg 117 has a groove 118 in which a rod 119 fixed to the piece 105 can slide, the roller 120 being intended to work with a ramp 121 for moving the end 105A of the piece 105 upwards against the action of the spring 112;

a jack 122 fixed on the piece 105 and/or on the body 100, said jack having a rod 123 provided with plate 124 with an opening in which the back rod 109 of the piece 105 is engaged, when the said jack is actuated the end 105B (opposite to the end 105A) is moved downwards so as to move upwards the swab 2;

a plate 125 provided with a passage provided with a thread;

a leg 126, a first end 126A of which is provided with a thread for working with the thread of the passage so as to adjust the position of the leg with respect to the plate 125, while the other end 126B of which is provided with a connecting element 127 to which is connected an arm 128 on which a rod provided with a roller 129 is mounted, the connecting element permitting a rotation of the arm 128 around the axis F of the leg 126 so that when screwing the leg 126 into the passage, the position of the roller 129 can be adjusted, said roller being intended to roll on a part of the support 8 which has a face for example parallel to the axis of the cylinder or in a rail having an axis parallel to the axis of the cylinder, and an element 130 attached to the piece 105 adjacent to the end 105A, the position of the free end 130A of which can be adjusted with respect to the piece 105, said element acting as a means for facilitating the correct placement of the swab with respect to the piece 105.

In case, the body can rotate around the cylinder 27, the body or the piece 101 can be provided with a roller 170 (shown in dashed lines in FIG. 8), said roller acting then as means for preventing or limiting a possible rotation of the body towards the element 1 to be coated. In case, a small rotation of the body around the cylinder 27 is admitted or required, the leg 126 can advantageously slide in the said passage as to adjust the position of the leg with respect to the plate 125. A spring 171 extending between the end 1261B and the plate 125 exerts a force pushing away the roller 129 from the plate 125, so that the roller 170 and the roller 129 always contacts the support. In case the part on which the roller 129 rolls is not parallel to the axis of the cylinder 27 (for example in case the said part is parallel to the axis of rotation of the element), a slight rotation of the body will occur during the movement of the carriage 11.

The supporting means 8 comprises:

a first arm 81 provided with a supporting rod 10A possibly driven in rotation by the motor 26 through the gear mechanisms 24, said supporting rod being adapted, possibly with a connector, to bear an end of the element the first arm 81 acting also as means for supporting an end of the cylinder 27;

a ramp 121A adjacent to the arm 8, said ramp 121 working with the roller 120 for moving upwards the piece 105;

a second arm 82 provided with a rotating supporting rod 10B being adapted, possibly with a connector, to bear an end of the element 1 and with a ramp 121B working with the roller 120 for moving upwards the piece 105, said arm being attached to the support 8 by fixing means permitting to vary the position of the arm 82 on the support so as to adjust the distance DIS between the arms 81 and 82 in function of the length of the element 1;

a third arm 83 acting as supporting means of the cylinder 27.

For varying the pushing force H of the swab on the element 1 during the movement of the carriage 11, The bearing elements or rods 10A, 10B are aligned along a first axis Z, said axis being the axis of rotation of the element to be coated when the element is rotated during its coating. The mobile carriage is movable along the axis B corresponding to the axis of the guiding path 9. The axis Z forms an angle $\alpha$ with a line B1 parallel to the axis B and crossing the said axis B, said angle being preferably comprised between 0.1° and 15°, for example between 0.1 and 5°, most specifically between 0.2 and 2°.

It means that the pushing force of the swab on the element will vary during the horizontal movement of the carriage 11 between a first pushing force when the carriage is adjacent to the arm 81 and a second pushing force when the carriage is adjacent to the arm 82. The said pushing force varies substantially continuously during the movement of the carriage during a coating operation. This variation of pushing force is due to the fact that during the movement of the swab along the element 1, the piece 105 is submitted to a slight rotation against the action of the spring 112, whereby the pushing force of the swab on to the element increases.

When the support 8 is placed vertically, the arm 81 is downwards with respect to the arm 82 and the coating operation is effected during the movement of the carriage from the arm 82 towards the arm 81. During said movement, the pushing force decreases continuously from a maximum pushing force of the swab 2 on the element adjacent to the arm 82 to a minimum pushing force in the neighborhood of the arm 81. The vertical downwards coating is advantageously made only on fixed element (not driven in rotation), such as on doctor blade or wiper blade.

The various position of the swab 2 with respect to the element 1 during the movement of the carriage will now be described.

In FIG. 10, the carriage 11 is adjacent to the arm 81. The roller 120 contacts the ramp 121A, whereby the end 105A of piece 105 is rotated upwards with respect to the axis C. The plate 110 is rotated around the axis D so as to form a gap between the plate 110 and the bottom of the groove 107. Due to the upwards movement of the end 105A, the leg 117 is rotated around the axis towards the piece 103. The rod 2A provided with the swab is engaged in the said gap and is adjusted so that the position of the swab 2 corresponds substantially to the end position of the element 130.

The plate 110 is then rotated around the axis for pressing the rod 2A against the bottom of the groove 107, so that the rod 2A is fixed on the piece 105, (FIG. 11)

The element to be coated placed between the rod 10A and 10B is possibly, but advantageously, driven in rotation.

Figure 12:
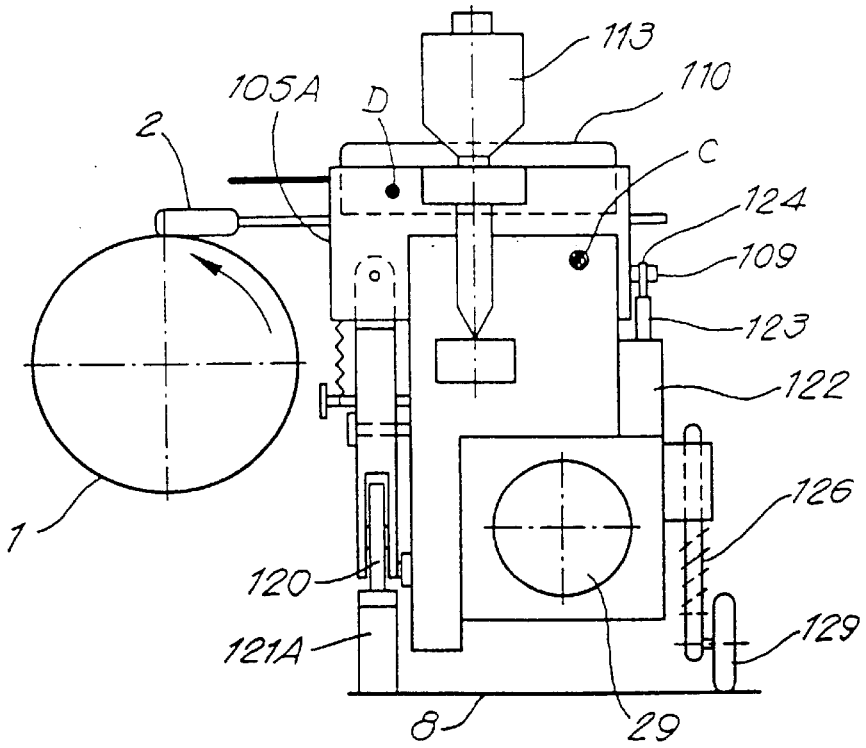

The toward movement X of the carriage 11 is now actuated. The roller 120 rolls downwardly on the ramp 121A, so that the leg 117 does no more exert a force against the action of the spring 112. During said rolling, the end 105A of the piece 105, as well as the swab 2 are novice downwards, so that when the roller does o mote contact the ramp 121A, the swab 2 contacts the element 1 to be coated. (FIG. 12)

Figure 13:
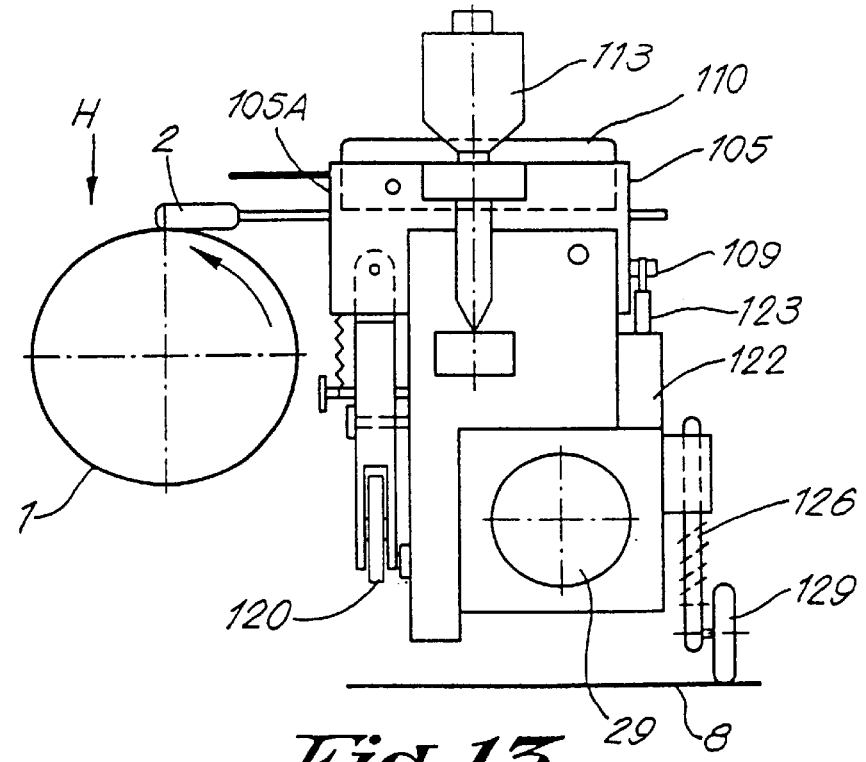

FIG. 13 shows the mortal movement of the carriage 11 between the ramps 121A and 121D.

Figure 14:
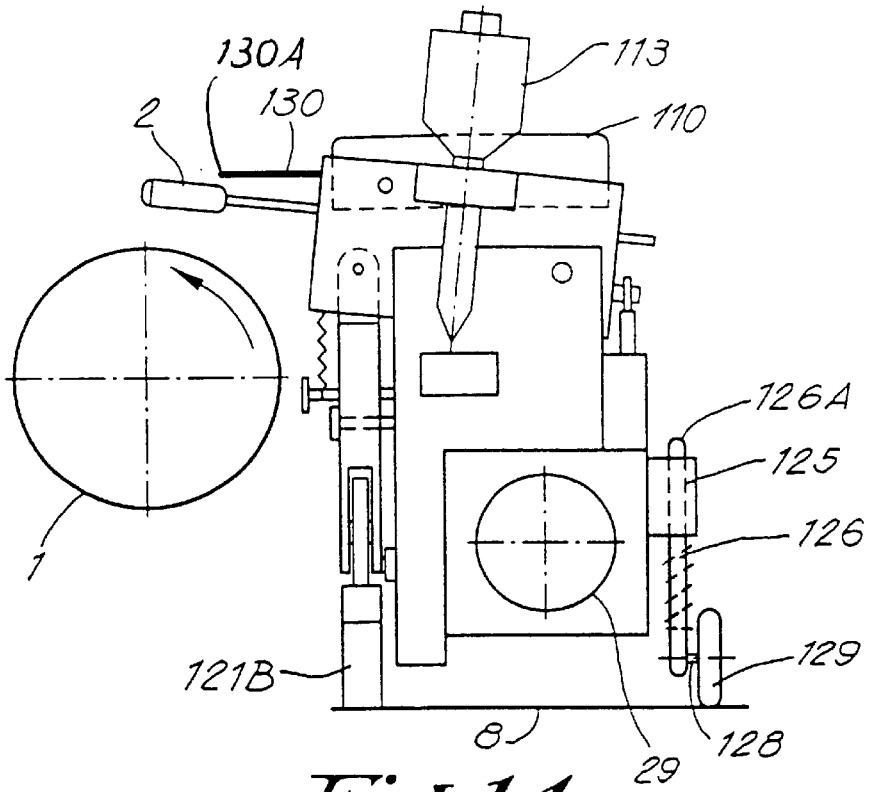

At the end of the coating operation, i.e. in the neighborhood of the arm 82, the roller 120 rolls upwardly on the ramp 121B. This upwards movement of the leg 117 causes an upwards rotation of the end 105A and of the swab 2 with respect to the axis E, whereby the swab no more contacts the element 1 (FIG. 14).

Figure 15:
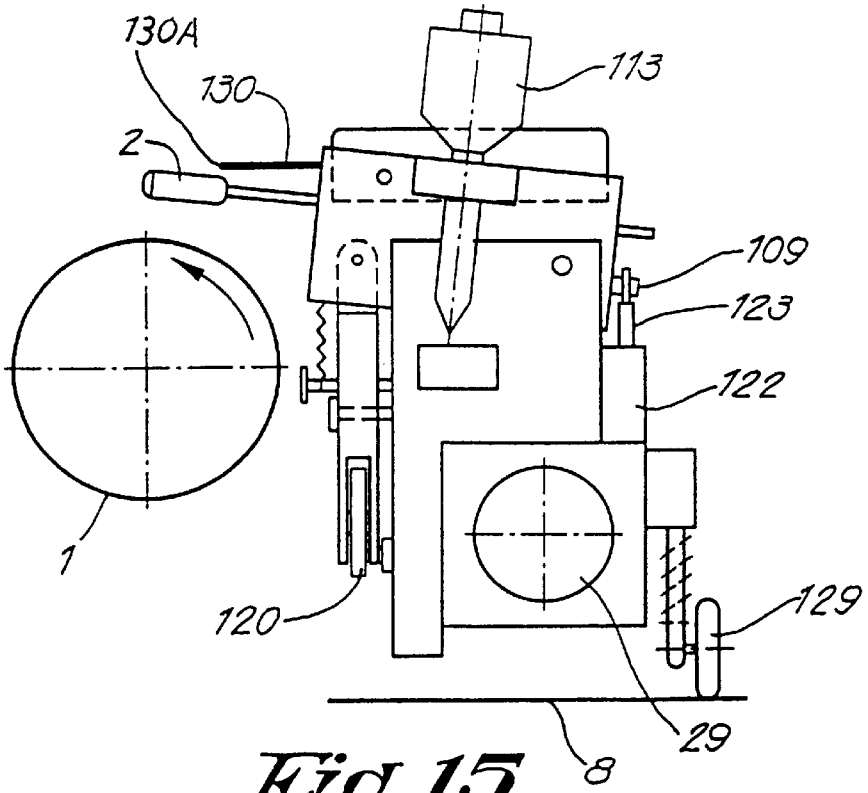

Thereafter, the carriage is moved back (Y) to a position adjacent to the arm 81. During said back movement, the jack 122 is actuated so that the rod 123 is moved downwardly so as to maintain the end 105A and the swab 2 in an upper position, so as to prevent the swab from contacting the element 1. (FIG. 15)

The device shown in the figure has been used for coating drums, magnetic roller, wiper blades and doctor blades of toner assembly, as well for primary charging roller and fuser roller.

When using the device, the atmosphere of the room is advantageously controlled so that the said atmosphere is substantially free of particles with a size greater than 1 $\mu$m and has a temperature of between 15 and 30° C., for example about 20° C. A cleaned air low, preferably a laminar air flow contacts the element during the coating, but also preferably before the coating and after the coating, for preventing the deposit of dust particles on the element to be coated before coating and on the coating.

For the coating of drums or rollers, the support is preferably substantially horizontal and the element to be coated is preferably driven in rotation (controlling rotation).

The thickness of the coating to be applied on the element is adjusted by the militants 113, for example to 100 $\mu$m or to less than 100 $\mu$m, such as 1,2,3,5,10,20,30,50,75 $\mu$m. The means 113 can possibly be adjusted s as to obtain thicker coating, such as 200 $\mu$m and more.

The speed of rotation and the speed of movement of the carriage can be controlled as usual for the man skilled in the art for obtaining a coating covering all the part of the drum or roller to be coated.

When using the device of the figures, it is possible to have the swab pressed with a control led pressure on the element for obtaining an uniform coating.

In the process of the invention, the swab is pushed with a pushing force on the element to be coated and in which the said pushing force is controlled during the relative movement of the swab with respect to the element so as to obtain an uniform coating of the element.

When the coating is made during a horizontal movement of the carriage, the swab is pushed with a vertical pushing force on the element to be coated and in which the said vertical pushing force is controlled during the relative movement of the swab with respect to the element so as that said vertical pushily force varies continuously from a First pushing force to a second pushing force, said second pushing force being greater than the first pushing force.

When the coating is made during a vertical downwards movement of the carriage, the swab is pushed with a horizontal pushing force on the element to be coated, the said horizontal pushing force is controlled during the relative movement of the swab with respect to the element so as that said horizontal pushing force varies continuously from a first pushing force to a second pushing force, said second pushing force being lower than the first pushing force.

When using the device in the process of coating, it is possible to ensure a back-and-forth motion of the swab with respect to the element to be coated. The swab contacts the element during at least a part of the forth motion, while the swab and the element are preferably aside during the back motion of the swab.

Various coating compositions can be used in the process of the invention. Said compositions can be sold in bottles or vials (the swabs having then to be (pregnated before use) or as preimpregnated swabs. Preferable compositions are compositions sold by PCT coatings under the name PCR KIT 1100A and 1500A, MR KIT 1100A,1500A, 1500B,1100C and 1500C, DB KIT 1100A,1500A,2100A and 2500A. Other compositions can however also be used. Said other compositions are the compositions sold by Cardinal Imaging Supplies under the name Easycoat, Instant Black, Superhard coat, ex super Mag, by Ameri tech Concept under the name PCR Re new, Cyclone Magroller Refinisher, Ultrahard Coat, by KLE under the name PCR Polycoat, PCR Ultracoat, Black Mag Roller Renew, Roller renew, OPC polycoat, Doctor Blade renew.

Possible coating compositions are compositions for obtaining an antistatic and anti abrasive coating, such as conductive and anti abrasive composition.

The invention relates also:

to a process for recycling a toner cartridge comprising at least a magnetic roller and a doctor blade, in which the said doctor blade and magnetic roller are removed from the cartridge, in which the removed doctor blade and magnetic roller are coated with an antistatic and anti abrasive coating, and in which, after coating, the said doctor blade and magnetic roller are placed back in the cartridge;

to a process for recycling a toner cartridge comprising at least a magnetic roller, a doctor blade, a photosensitive drum, a wiper blade, a fuser roller and a primary charge roller, in which the photosensitive drum and the wiper blade are removed from the cartridge, in which the removed photosensitive drum and wiper blade are coated with an antistatic and anti abrasive coating preferably in a device of the invention, and in which, after coating, the said photosensitive drum and the wiper blade are placed back in the cartridge to a process for recycling a toner cartridge comprising at least a magnetic roller, a doctor blade, a photosensitive drum, a wiper blade, a first roller and a primary charge roller, in which at least three elements selected among the group consisting of magnetic roller, doctor blade, photosensitive d rum, wiper blade, fuser roller and primary charge roller are removed from the cartridge, in which the said removed elements are coated with an anti abrasive coating preferably in a device of the invention, and in which, after coating, the said elements are placed back in the cartridge.

Possibly the cabinet 3 can be provided with lamps 150, for example colored lamps, red lamps, etc. and/or with panels acting as filter, for preventing the passage in the room of specific luminous waves.

Figure 8:
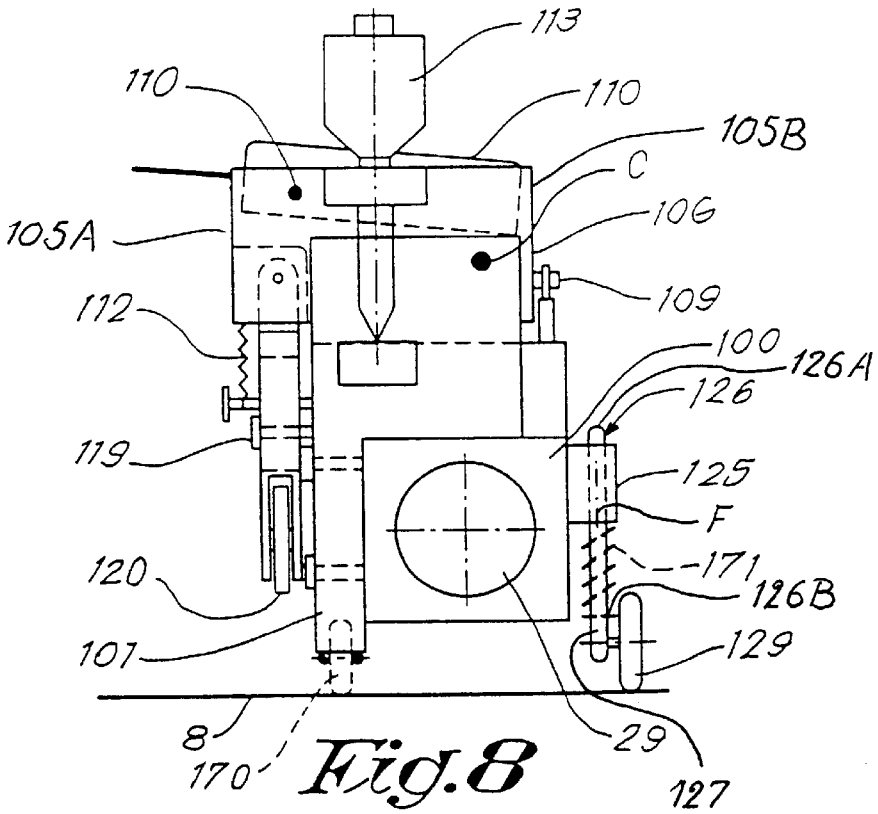
Figure 9:
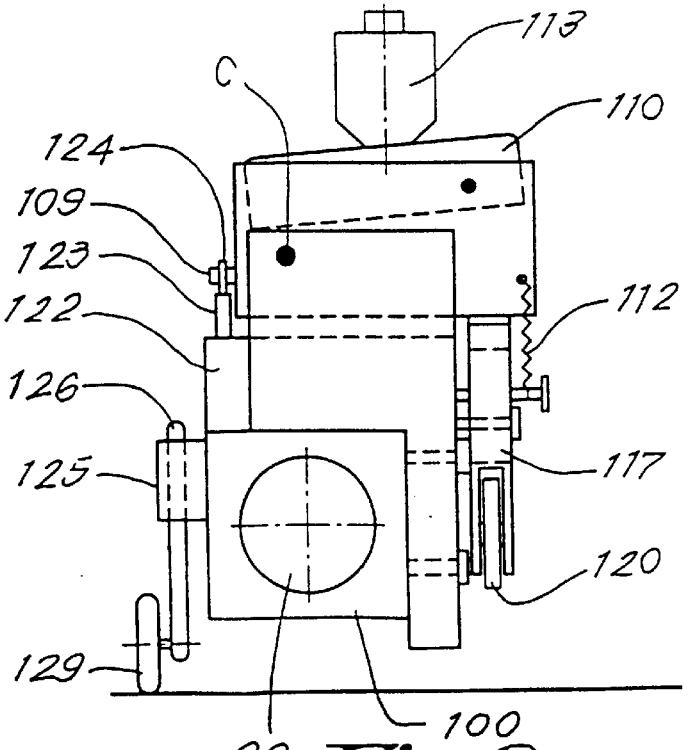
Figure 16:
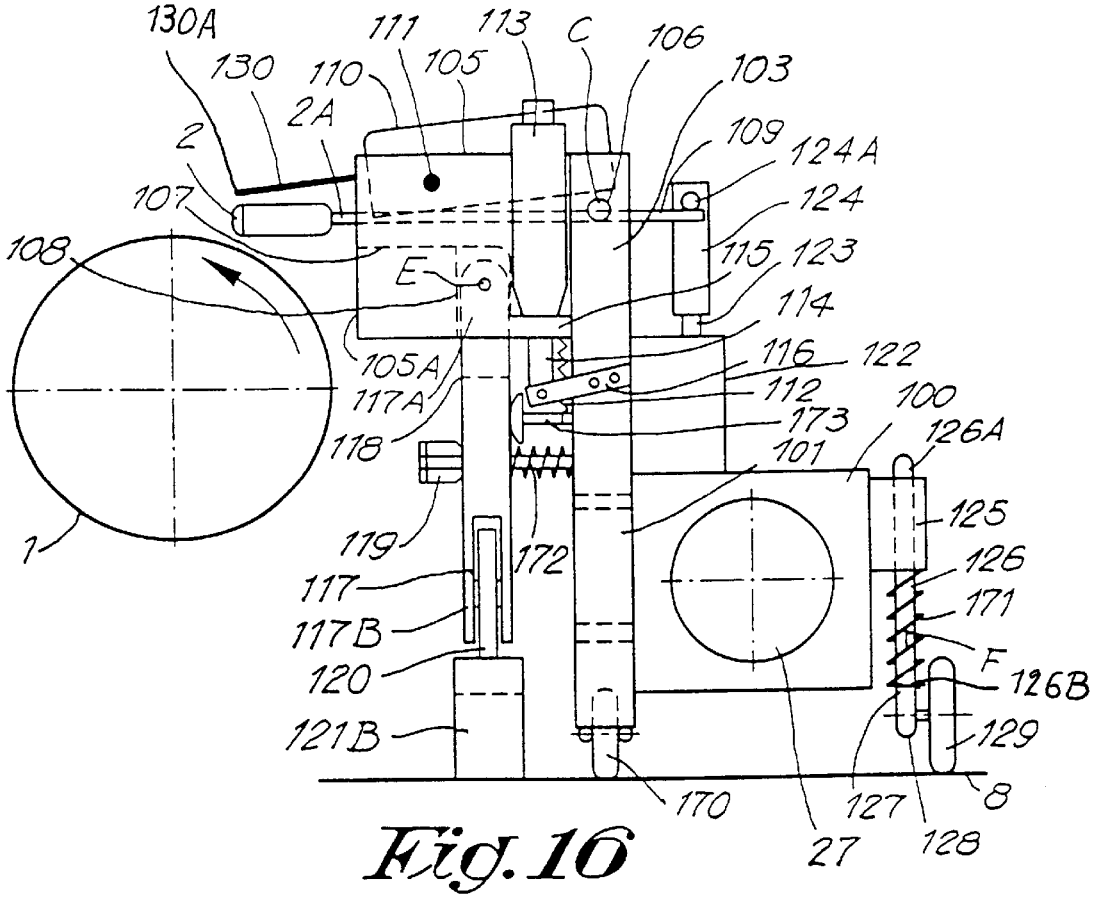
FIG. 16 is a view of an embodiment of the carriage of the coating device, said view being similar to that of FIG. 8.
Figure 17:
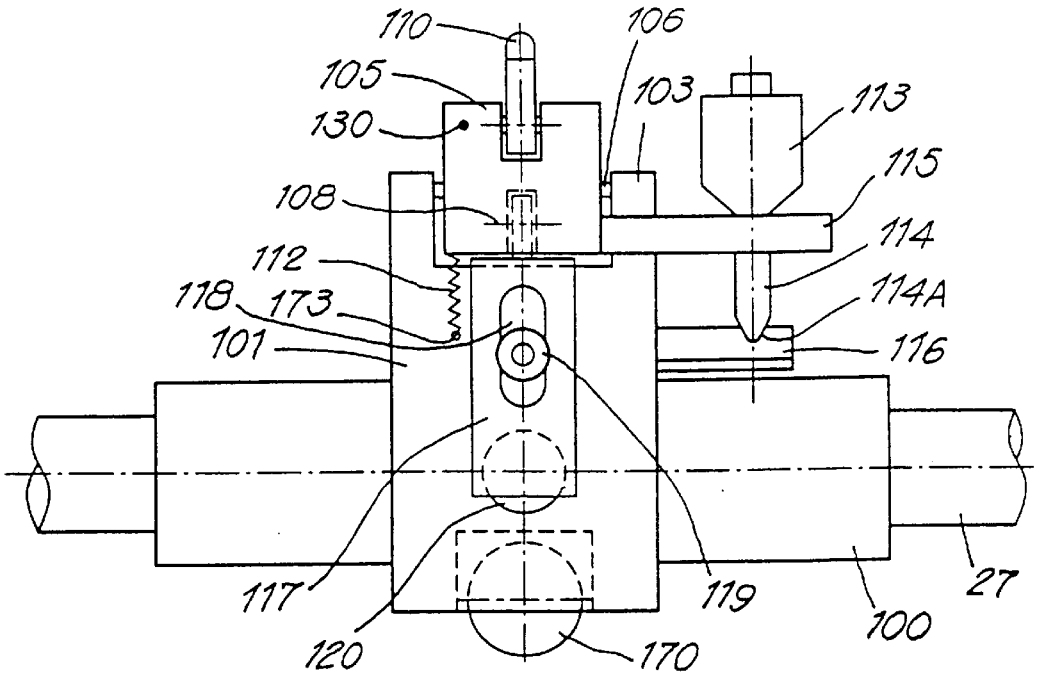
FIG. 17 is a front view of the embodiment shown in FIG. 16.

FIG. 16 is a view similar to that of FIG. 8, but for another embodiment of the carriage 11. Said embodiment is similar to that of FIG. 8, so that only a schematic side view is given.

The carriage 11 of FIG. 16 comprises:

a body 100 with the cylindrical hold 29 in which the cylinder 27;

a piece 101 attached to the body 100, said piece 101 having two arms 103 defining there between a channel;

a piece 105 connected to the arms 103 by meets of a pivot 106, whereby said piece 105 can pivot around the axis C, said piece 105 having an back rod 109, an upper groove 107 and a downwards recess 108;

a plate 110 partly engaged in the upper groove 107 and connected to the 110 piece 105 by a pivot 111, so that the plate can pivot around an axis between a position in which the rod 2A of the swab 2 can be engaged between the bottom of the groove 107 and the plate and a position in which the plate 110 acts on the rod 2A for preventing its movement in the groove 107;

a spring 172 extending between the piece 101 and the leg 117, said spring exerting a force on the leg 117 so as to push said leg away from the piece 101;

a spring 112 extending between a rod 173 fixed on the piece 101 and the piece 105;

a means 113 for limiting the downwards movement of the end 115A, said means acting therefore as means for adjusting the pressure of the swab 2 on the element to be coated and by means for adjusting the thickness of the coating on the element, said means 113 comprising for example a control means attached to a arm 115 fixed to the piece 105, said control means controlling the displacement of an adjustable screw or rod 114, the free end 114A of which is intended to work with a plate 116 attached to the piece 101;

a leg 117 having an upper part 117A engaged in the recess 108 of the piece 105, said upper part 117A being connected to the said piece 105 by means of a pivot 118 whereby the leg can pivot around the axis P, the downwards part 117B of the leg 117 is provided with a roller 120, while the central part of the leg 117 has a groove 118 in which a rod 119 fixed to the piece 105 can slide, the roller 120 being intended to work with a ramp 121 for moving the end 105A of the piece 105 upwards against the action of the spring 112;

a jack 122 fixed on the body 100, said jack having a rod 123 provided with plate 124 with a rod 121A acting on the back rod 109 of the piece 105 for moving upwardly the end 105A (when the said jack is actuated the end 105B (opposite to the end 105SA) is moved downwards so as to move upwards the swab 2);

a plate 125 provided with a passage;

a roller 170 mounted on the piece 101, said roller being adapted for rolling on the support 8;

a leg 126, a first end 126A of which is engaged in the passage of the place 125 so that the said leg can slide in the said passage as to adjust the position of the leg with respect to the plate 125, while the other end 126B of which is provided with a connecting element 127 to which is connected connecting element permitting a rotation of the arm 128 around the axis F of the leg 126, a spring 171 extending between the end 12613 and the plate 125 so axis to exert a force pushing away the roller 129 from the plate 125, and an element 130 attached to the piece 105 adjacent to the end 105A, the position of the free end 130A of which can be adjusted with respect to the piece 105, said element acting as a means for facilitating the correct placement of the swab with respect to the piece 105.

What I claim is:

1. A process for recycling a toner cartridge, said cartridge comprising at least a used magnetic roller and a used doctor blade, said process comprising the steps of:

removing said doctor blade and magnetic roller from the cartridge, treating said doctor blade to thereby substantially restore the shape of said doctor blade, coating the removed doctor blade and magnetic roller with an antistatic and anti abrasive coating, and placing the said doctor blade and magnetic roller back in the cartridge.

2. The process of claim 1, wherein in said treating step, the shape of said doctor blade is substantially restored by heating and applying pressure to said doctor blade.

3. The process of claim 1, wherein said treating step occurs before said coating step.

4. A process for recycling a toner cartridge comprising at least a used magnetic roller, a used doctor blade, a used photosensitive drum, a used wiper blade, a used fuser roller and a used primary charge roller, in which the photosensitive drum and the wiper blade are removed from the cartridge, in which the removed photosensitive drum and wiper blade are coated with an antistatic and anti abrasive coating, and in which the said coated photosensitive drum and the coated wiper blade are placed back in the cartridge.

5. A process for recycling a toner cartridge comprising at least a used magnetic roller, a used doctor blade, a used photosensitive drum, a used wiper blade, a used fuser roller and a used primary charge roller, in which at least three elements selected among the group consisting of said used magnetic roller, said used doctor blade, said used photosensitive drum, said used wiper blade, said used fuser roller and said used primary charge roller are removed from the cartridge, in which the said removed elements are coated with an anti abrasive coating, and in which, after coating, the said elements are placed back in the cartridge.

6. The process of claim 5, comprising the additional step of treating the used doctor blade to thereby substantially restore the shape of said doctor blade.

* * * * *